US009616261B1

(12) United States Patent
Rambert

(10) Patent No.: US 9,616,261 B1
(45) Date of Patent: Apr. 11, 2017

(54) FIREMAN SHIELD ASSEMBLY

(71) Applicant: John Rambert, Glen Allen, VA (US)

(72) Inventor: John Rambert, Glen Allen, VA (US)

( * ) Notice: Subject to any disclaimer, the term of this patent is extended or adjusted under 35 U.S.C. 154(b) by 0 days.

(21) Appl. No.: 15/176,334

(22) Filed: Jun. 8, 2016

(51) Int. Cl.

| | |
|---|---|
| ***A62C 8/08*** | (2006.01) |
| ***E04H 15/36*** | (2006.01) |
| ***E04H 15/02*** | (2006.01) |
| ***E04H 15/00*** | (2006.01) |
| ***E04H 9/16*** | (2006.01) |
| ***E04B 1/94*** | (2006.01) |
| ***E04B 1/343*** | (2006.01) |
| ***F41H 5/14*** | (2006.01) |

(52) U.S. Cl.
CPC ..... *A62C 8/08* (2013.01); *E04B 1/34368* (2013.01); *E04B 1/94* (2013.01); *E04H 9/16* (2013.01); *E04H 15/008* (2013.01); *E04H 15/02* (2013.01); *E04H 15/36* (2013.01); *F41H 5/14* (2013.01)

(58) Field of Classification Search
CPC ..... A62C 8/08; A62C 3/0214; A62C 3/0257; A62C 2/06; A62C 2/10; F41H 5/08; F41H 5/14; E04B 1/94; E04B 1/34368; E04H 15/008; E04H 15/36; E04H 9/16
USPC ..... 52/DIG. 12; 135/124, 900, 906, 912; 89/36.07, 36.09; 169/48, 52
See application file for complete search history.

(56) References Cited

U.S. PATENT DOCUMENTS

| | | | | | |
|---|---|---|---|---|---|
| 1,253,964 | A * | 1/1918 | Hack | F41H 5/14 | 109/9 |
| 2,151,908 | A * | 3/1939 | Gottlieb | E04B 1/3441 | 135/117 |
| 2,209,654 | A * | 7/1940 | Loeser, Jr. | F41H 5/08 | 109/49.5 |
| 2,470,337 | A * | 5/1949 | Campbell | E04F 10/02 | 135/131 |
| 2,575,572 | A * | 11/1951 | Wickstrum | E04H 15/58 | 135/118 |
| 2,688,068 | A * | 8/1954 | Marr | F26B 3/28 | 219/391 |
| 2,698,629 | A * | 1/1955 | Hall | E04H 6/04 | 134/123 |
| 2,823,744 | A * | 2/1958 | Garris | A62B 3/00 | 160/135 |
| 3,064,667 | A * | 11/1962 | Marino | B60J 7/062 | 135/120.3 |
| 3,092,126 | A * | 6/1963 | Smith | B60J 11/00 | 135/118 |
| 3,131,705 | A * | 5/1964 | Marino | B60P 7/04 | 135/131 |
| 3,193,017 | A * | 7/1965 | Walker | A62B 3/00 | 169/25 |
| 4,693,634 | A | 9/1987 | Chiaves | | |
| 5,263,507 | A * | 11/1993 | Chuang | E04H 15/46 | 135/140 |

(Continued)

FOREIGN PATENT DOCUMENTS

| | | | | |
|---|---|---|---|---|
| WO | WO0020198 | 4/2000 | | |
| WO | 2008115065 A1 * | 9/2008 | | A01G 9/1407 |

*Primary Examiner* — Robert Canfield

(57) ABSTRACT

A fireman shield assembly for inhibiting a fireman from being struck by falling, burning debris includes a frame that may be positioned around a fireman. A shield is positioned over the frame. The covers the fireman when the fireman stands in the frame. Thus, the shield inhibits falling debris from striking the fireman.

9 Claims, 3 Drawing Sheets

(56) References Cited

U.S. PATENT DOCUMENTS

| | | | | | |
|---|---|---|---|---|---|
| 5,331,777 | A * | 7/1994 | Chi-Yuan | E04H 15/505 | 135/124 |
| 5,341,973 | A | 8/1994 | Dawes et al. | | |
| 5,505,265 | A * | 4/1996 | O'Neil | A62C 2/06 | 160/351 |
| 5,595,203 | A * | 1/1997 | Espinosa | E04H 15/36 | 135/123 |
| 5,628,066 | A | 5/1997 | Gottlieb et al. | | |
| 5,967,162 | A * | 10/1999 | Bolton | E04H 6/025 | 135/122 |
| 6,048,805 | A | 4/2000 | Gottfried | | |
| D430,306 | S * | 8/2000 | Goldwitz | D25/61 | |
| 6,505,638 | B1 * | 1/2003 | Powell | E04H 15/18 | 135/115 |
| 6,763,633 | B2 * | 7/2004 | Cote | E04B 1/344 | 135/128 |
| 6,845,701 | B2 * | 1/2005 | Drackett | F41H 5/14 | 89/36.09 |
| 6,881,506 | B2 | 4/2005 | Anderson et al. | | |
| 7,007,706 | B2 * | 3/2006 | Pinnell | A63C 19/12 | 135/123 |
| 9,187,892 | B1 * | 11/2015 | Orr | E04B 1/34305 | |
| 2004/0255769 | A1 * | 12/2004 | Drackett | F41H 5/14 | 89/36.09 |
| 2008/0257394 | A1 * | 10/2008 | Tseng | E04H 15/505 | 135/124 |
| 2012/0227990 | A1 | 9/2012 | Burnham | | |
| 2015/0152636 | A1 * | 6/2015 | Connell | E04B 1/94 | 52/79.1 |

* cited by examiner

FIREMAN SHIELD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to shield devices and more particularly pertains to a new shield device for inhibiting a fireman from being struck by falling, burning debris.

BRIEF SUMMARY OF THE INVENTION

An embodiment of the disclosure meets the needs presented above by generally comprising a frame that may be positioned around a fireman. A shield is positioned over the frame. The covers the fireman when the fireman stands in the frame. Thus, the shield inhibits falling debris from striking the fireman.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
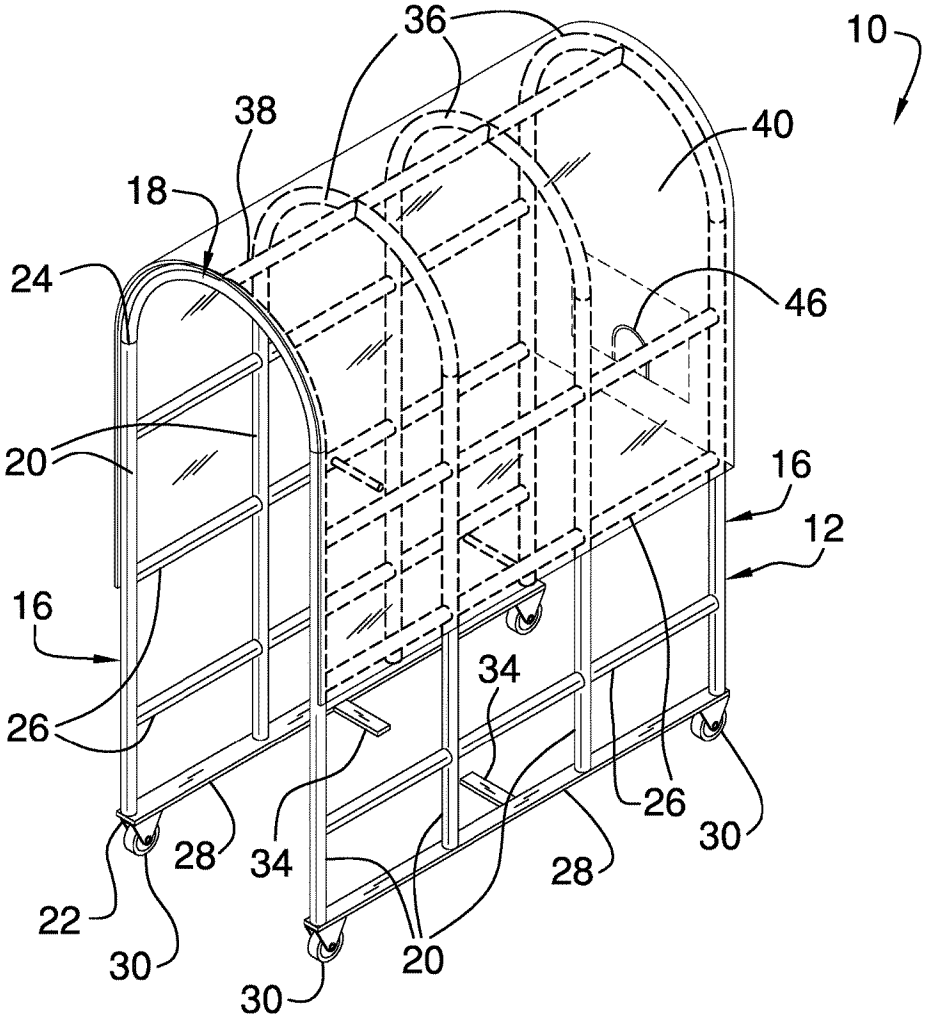
FIG. 1 is a top perspective view of a fireman shield assembly according to an embodiment of the disclosure.
Figure 3:
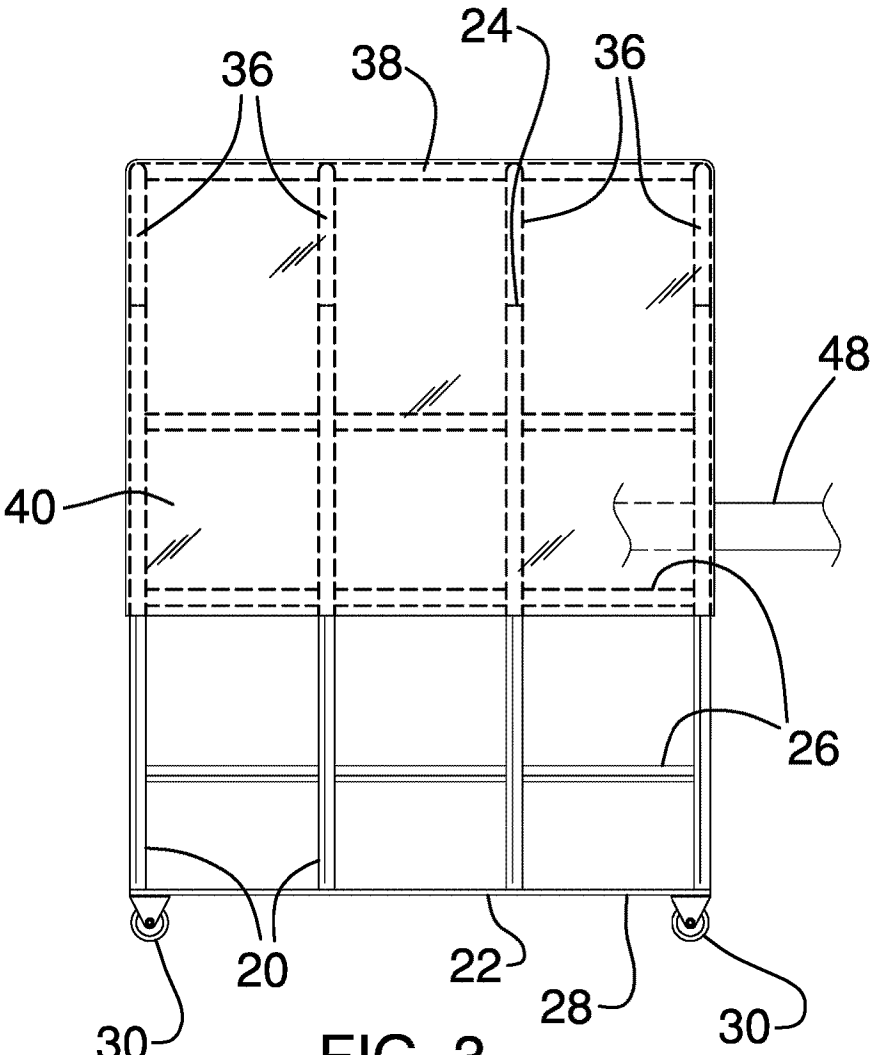
FIG. 3 is a right side view of an embodiment of the disclosure.
Figure 2:
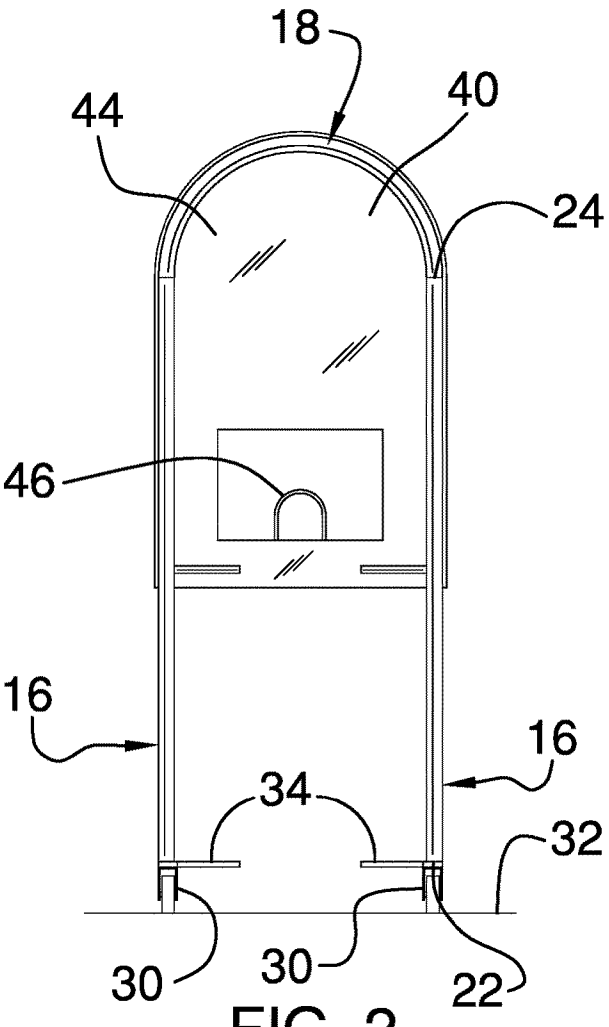
FIG. 2 is a front view of an embodiment of the disclosure.
Figure 4:
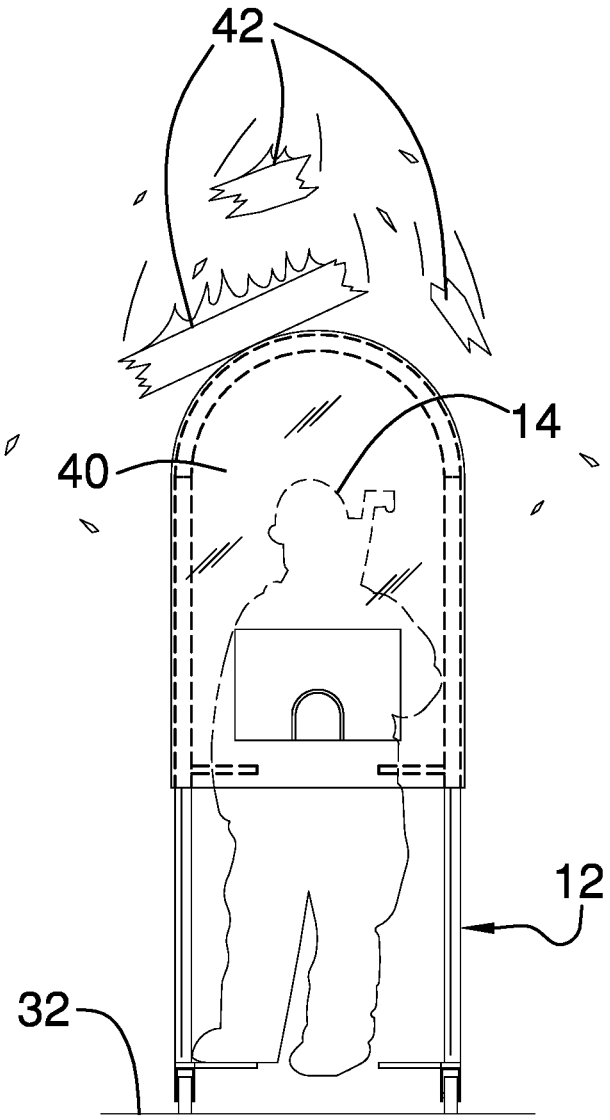
FIG. 4 is a perspective in-use view of an embodiment of the disclosure.

With reference now to the drawings, and in particular to FIGS. 1 through 4 thereof, a new shield device embodying the principles and concepts of an embodiment of the disclosure and generally designated by the reference numeral 10 will be described.

As best illustrated in FIGS. 1 through 4, the fireman shield assembly 10 generally comprises a frame 12 that may be positioned around a fireman 14. The frame 12 has a pair of upright sections 16 and central section 18 extending between the upright sections 16. The upright sections 16 are spaced apart from each other. The central section 18 is curved between the upright sections 16 such that the frame 12 defines an arch.

Each of the upright sections 16 comprises a plurality of first members 20. Each of the first members 20 is spaced apart from each other. Each of the first members 20 is vertically oriented and each of the first members 20 has a first end 22 and a second end 24. Each of the first members 20 may have height ranging between one meter and two meters.

A plurality of lateral members 26 is provided. Each of the lateral members 26 is coupled to and extends between the first members 20. Thus, the first members 20 are spaced apart from each other. The lateral members 26 are spaced apart from each other and are distributed between the first end 22 and the second end 24. The plurality of lateral members 26 includes a bottom lateral member 28. The bottom lateral member 28 is coupled to the first end 22 of the first members 20 of an associated one of the upright sections 16.

A plurality of wheels 30 is provided. Each of the wheels 30 are rotatably coupled the bottom lateral member 28. Thus, the wheels 30 may roll along a support surface 32. The support surface 32 may be a floor of a burning structure or the like. Each of the wheels 30 may comprise casters or the like.

A pair of supports 34 is provided. Each of the support 34 is coupled to and extends inwardly from the bottom lateral members 28 of an associated one of the upright sections 16. Thus, each of the supports 34 may have the fireman 14 stand thereon. Each of the supports 34 is centrally positioned in the frame 12.

The central section 18 comprises a plurality of curved members 36. Each of the curved members 36 is coupled between the second end 24 of an associated one of the first members 20 corresponding to each of the upright sections 16. A horizontal member 38 is coupled between each of the curved members 36. The horizontal member 38 may have a length ranging between one and one half meters and two meters.

A shield 40 is positioned over the frame 12. Thus, the shield 40 covers the fireman 14 when the fireman 14 stands in the frame 12. The shield 40 extends over the central section 18 and substantially downwardly along each of the upright sections 16. The shield 40 is comprised of a fire resistant material. Thus, the shield 40 inhibits the fireman 14 from being struck by burning, falling debris 42.

The shield 40 has a front side 44 and the front side 44 extends between the pair of upright sections 16. The front side 44 has an opening 46 extending therethrough. The opening 46 may have a fire hose 48 extended therethrough. Thus, the fireman 14 may manipulate the fire hose 48 when the fireman 14 stands beneath the shield 40. The shield 40 may be comprised of a translucent material. Thus, the fireman 14 may be able to see when the fireman 14 stands beneath the shield 40.

In use, the fireman 14 stands beneath the shield 40 when the fireman 14 enters a burning structure. The fire hose 48 is extended through the opening 46. The wheels 30 are rolled along the support surface 32 and the frame 12 is positioned at a selected location. The fireman 14 stands on the supports 34 and the fireman 14 manipulates the fire hose 48 to fight a fire. The shield 40 inhibits burning, falling debris 42 from striking the fireman 14 while the fireman 14 fights the fire.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fireman shield assembly being configured to inhibit falling debris from striking a fireman, said assembly comprising:

a frame being configured to be positioned around the fireman, said frame having a pair of upright sections and central section extending between said upright sections such that said upright sections are spaced apart from each other, said central section being curved between said upright sections such that said frame defines an arch;

a shield being positioned over said frame wherein said shield is configured to cover the fireman when the fireman stands in said frame thereby inhibiting falling debris from striking the fireman;

a plurality of wheels, each of said wheels being rotatably coupled to extend downwardly from said frame wherein said wheels are configured to roll along a support surface; and a pair of centrally positioned supports, each of said supports being coupled to said frame, each said support extending inwardly wherein each of said supports is configured to have the fireman stand thereon while positioned within said frame.

2. The assembly according to claim 1, wherein said pair of upright comprises a plurality of first members, each of said first members being spaced apart from each other, each of said first members being vertically oriented, each of said first members having a first end and a second end.

3. The assembly according to claim 2, further comprising a plurality of lateral members, each of said lateral members being coupled to and extending between said first members such that said first members are spaced apart from each other, said lateral members being spaced apart from each other and distributed between said first end and said second end, said plurality of lateral members including a bottom lateral member, said bottom lateral member being coupled to said first end of said first members of an associated one of said upright sections.

4. The assembly according to claim 3, further comprising said plurality of wheels being rotatably coupled to said bottom lateral member.

5. The assembly according to claim 3, further comprising said pair of supports being coupled to and extending inwardly from said bottom lateral members of an associated one of said upright sections wherein each of said supports is configured to have the fireman stand thereon.

6. The assembly according to claim 1, wherein said central section comprises:

a plurality of curved members, each of said curved members being coupled between said second end of an associated one of said first members corresponding to each of said upright sections; and a horizontal member being coupled between each of said curved members.

7. The assembly according to claim 1, wherein:

said shield extends over said central section and substantially downwardly along each of said upright sections, said shield having a front side, said front side extending between said pair of upright sections.

8. The assembly according to claim 7, wherein said front side has an opening extending therethrough wherein said opening is configured to have a fire hose extended therethrough thereby facilitating the fireman to manipulate the fire hose, said shield being comprised of a fire resistant material wherein said shield is configured to inhibit the fireman from being struck by burning, falling debris.

9. A fireman shield assembly being configured to inhibit falling debris from striking the fireman, said assembly comprising:

a frame being configured to be positioned around a fireman, said frame having a pair of upright sections and central section extending between said upright sections such said upright sections are spaced apart from each other, said central section being curved between said upright sections such that said frame defines an arch, said pair of upright sections comprising:

a plurality of first members, each of said first members being spaced apart from each other, each of said first members being vertically oriented, each of said first members having a first end and a second end, a plurality of lateral members, each of said lateral members being coupled to and extending between said first members such that said first members are spaced apart from each other, said lateral members being spaced apart from each other and distributed between said first end and said second end, said plurality of lateral members including a bottom lateral member, said bottom lateral member being coupled to said first end of said first members of an associated one of said upright sections, a plurality of wheels, each of said wheels being rotatably coupled to said bottom lateral members wherein said wheels are configured to roll along a support surface, and a pair of centrally positioned supports, each of said supports being coupled to and extending inwardly from said bottom lateral members of an associated one of said upright sections wherein each of said supports is configured to have the fireman stand thereon; and said central section comprising:

a plurality of curved members, each of said curved members being coupled to between said second end of an associated one of said first members corresponding to each of said upright sections, and a horizontal member being coupled between each of said curved members; and a shield being positioned over said frame wherein said shield is configured to cover the fireman when the fireman stands in said frame, said shield extending over said central section and substantially downwardly along each of said upright sections, said shield having a front side, said front side extending between said pair of upright sections, said front side having an opening extending therethrough wherein said opening is configured to have a fire hose extended therethrough thereby facilitating the fireman to manipulate the fire hose, said shield being comprised of a fire resistant material wherein said shield is configured to inhibit the fireman from being struck by burning, falling debris.

* * * * *